US008476515B2

(12) United States Patent
Coady

(10) Patent No.: US 8,476,515 B2
(45) **Date of Patent: *Jul. 2, 2013**

(54) LOCKING MECHANISM FOR PERCUSSION MUSICAL INSTRUMENT

(75) Inventor: William Joseph Coady, Port Hawkesbury (CA)

(73) Assignee: Billdidit Inc., Sydney, NS (CA)

( * ) Notice: Subject to any disclaimer, the term of this patent is extended or adjusted under 35 U.S.C. 154(b) by 96 days.

This patent is subject to a terminal disclaimer.

(21) Appl. No.: 13/096,476

(22) Filed: Apr. 28, 2011

(65) Prior Publication Data

US 2011/0265633 A1 Nov. 3, 2011

Related U.S. Application Data

(63) Continuation-in-part of application No. 12/942,548, filed on Nov. 9, 2010, now Pat. No. 8,153,877.

(60) Provisional application No. 61/259,615, filed on Nov. 9, 2009.

(51) Int. Cl.
*G10D 13/02* (2006.01)

(52) U.S. Cl.
USPC ..... 84/422.3

(58) Field of Classification Search
USPC ..... 84/422.1, 422.2, 422.3, 421
See application file for complete search history.

(56) References Cited

U.S. PATENT DOCUMENTS

| | | | | |
|---|---|---|---|---|
| 4,528,888 | A | 7/1985 | Hoshino | |
| 4,667,562 | A | 5/1987 | Lee | |
| 4,730,532 | A | 3/1988 | Bauerfind | |
| 4,928,567 | A | 5/1990 | Kurosaki | |
| 5,028,776 | A | 7/1991 | Forti | |
| 5,438,903 | A | 8/1995 | Cropek | |
| 6,166,307 | A | 12/2000 | Caulkins et al. | |
| 6,201,173 | B1 | 3/2001 | Black | |
| 7,671,263 | B1 | 3/2010 | Coady | |
| 8,153,877 | B2 * | 4/2012 | Coady | 84/422.1 |

* cited by examiner

*Primary Examiner* — Kimberly Lockett
(74) *Attorney, Agent, or Firm* — Marks & Clerk; Richard J. Mitchell

(57) ABSTRACT

A high hat cymbal has a magnetic clutch that engages the top cymbal and allows it to be controlled by a standard high hat foot pedal. When the drummer's foot is removed from the high hat foot pedal, the magnetic clutch strikes a mechanical arm, which causes the magnetic clutch to disengage without any action, required on the part of the drummer. The top cymbal can be re-engaged by the magnetic clutch so that the high hat foot pedal can now be operated again, simply by depressing the high hat foot pedal. A trip bar may be provided to provide for automatic disengagement of the clutch mechanism.

28 Claims, 8 Drawing Sheets

LOCKING MECHANISM FOR PERCUSSION MUSICAL INSTRUMENT

CROSS REFERENCE TO RELATED APPLICATION

This application is a continuation-in-part of co-pending U.S. patent application no. 12/942,548, filed Nov. 9, 2010, which claims the benefit under 35 USC 119(e) of U.S. provisional application No. 61/259,615, filed Nov., 9, 2009, the contents of which are herein incorporated by reference.

FIELD OF THE INVENTION

This invention relates to the field of percussion instruments, such as high hat cymbals, and in particular to a locking mechanism for use in such instruments.

BACKGROUND OF THE INVENTION

Most bands playing popular modern music will include a drummer, playing a drum set, also called a drum kit. The drum kit typically consists of a bass drum, snare drum, tom toms, cymbals, and a high hat cymbal. Modern drumming techniques have evolved significantly since the advent of rock and roll music in the 1950's. Modern drummers have a wide variety of percussive instruments, as well as the typical kit components, and they arrange these different instruments to suit their particular tastes and styles.

A high hat cymbal actually consists of two cymbals facing each other. The high hat cymbal is struck by a drumstick, but is also operated using a foot pedal. The foot pedal operation consists of "closing and opening" the high hat, that is bringing the top cymbal into tight contact with the bottom cymbal to make a staccato sound, known as closing the high hat, or allowing the top cymbal to rise into looser contact with the bottom cymbal creating a ringing or less staccato sound, known as opening the high hat.

The drummer keeps the high hat in the closed position by depressing the foot pedal. Releasing the foot pedal allows a spring mechanism to raise the top cymbal into the open position. With a conventional high hat arrangement, the drummer must have a foot on the high hat foot pedal to operate the instrument. Also, to operate the high hat cymbal in the closed position, the drummer must still have one foot on the foot pedal. This "ties up" one foot and makes it impossible for the drummer to use that foot to operate other instruments.

The bass drum is struck by a mallet, which is operated by a foot pedal. Modern drumming techniques, especially in rock genres such as hard rock, heavy metal, speed metal, etc., call for a technique that uses two bass drum pedals, commonly referred to as "double bass". Since the drummer only has two feet, he or she cannot operate two bass drum pedals and a high hat pedal simultaneously.

Since the desired default position for the high hat cymbal is the closed position, it is known to disengage the top cymbal from the central shaft that ties it to the foot pedal in order to drop into a closed position with the bottom cymbal. Ideally, disengaging the top cymbal and allowing it to fall into the closed position should be done with minimum distraction to the drummer. However, the top cymbal needs to be re-engaged so that the drummer can operate it using the high hat foot pedal, again, while minimizing distractions to the drummer. In summary, the top cymbal needs to be engaged and disengaged without interfering with the drummer's playing in any way.

Attempts have been made to solve this problem in the prior art, for example, as described in U.S. Pat. Nos. 4,667,562; 4,730,532; 4,928,567. These designs require action on the part of the drummer, leading to distraction, or are overly complex, see, for example, U.S. Pat. No. 5,028,776, or create additional clutter in the drummers playing area.

SUMMARY OF THE INVENTION

While our U.S. Pat. No. 7,671,263 provides an effective solution, the present invention represents a further improvement of the solution disclosed in that patent.

Like the above patent the present invention addresses the problems arising in the prior art in one aspect by providing automatic disengagement of the upper cymbal as it returns to its raised position by operation of the spring mechanism associated with the foot pedal, and in another aspect by providing an advantageous locking mechanism that is reliable and less complex than the prior art.

Thus, in accordance with one aspect of the invention there is provided a locking mechanism for a musical percussion instrument comprising a pair of upper and lower cymbals, wherein the lower cymbal is fixedly mounted on a tubular support, and the upper cymbal can be raised or lowered by means of a foot-operated control rod extending within the tubular support, the locking mechanism comprising a magnetic clutch mechanism mountable on the control rod for releasably bringing said upper cymbal into engagement with the control rod, and wherein the magnetic clutch mechanism includes respective first and second mating surfaces which in their normal position are engaged with each other by magnetic attraction, said mating surfaces being tiltable relative to each other; and wherein said clutch mechanism includes a trip member operable upon actuation to tilt at least one of said mating surfaces so as to at least partially separate mating surfaces and thereby break the engagement and allow said upper cymbal to fall onto said lower cymbal.

In a second aspect the invention provides a hi-hat cymbal set, comprising a pair of upper and lower cymbals, wherein the lower cymbal is fixedly mounted on a tubular support, and the upper cymbal can be raised or lowered by means of a foot-operated control rod extending within the tubular support, the locking mechanism; and a magnetic clutch mechanism mountable on the control rod for releasably bringing said upper cymbal into engagement with the control rod, and wherein the magnetic clutch mechanism includes respective first and second mating surfaces which in their normal position are engaged with each other by magnetic attraction, said mating surfaces being tiltable relative to each other; and wherein said clutch mechanism includes a trip member operable upon actuation to tilt at least one of said mating surfaces so as to at least partially separate mating surfaces and thereby break the engagement and allow said upper cymbal to fall onto said lower cymbal.

It is possible to tilt either surface. On one embodiment, the lower surface can be in the form of a disk attached to the upper cymbal by a resilient grommet, for example, which is made of rubber or elastomeric material. In this embodiment, the upper cymbal may be mounted on a sleeve slidable on the tubular support.

This mechanism is well adapted for use with the trip bar, but it nevertheless offers advantages over the prior art in terms of reliability and simplicity. The tilting of the mating surface releases the magnetic engagement and allows the upper cymbal to fall onto the lower cymbal in the closed position, yet also ensures quick re-engagement of the clutch when the upper collar component is brought back down onto the lower collar component by operating the foot pedal. As soon as the mating surfaces come into engagement, the clutch re-engages without the need for any movable locking members or the like.

The drummer can now strike the hi-hat cymbals in the closed position while working the second bass pedal, or other instrument. When he/she wishes to operate the high hat again, he/she simply depresses the foot pedal causing the vertical shaft and the second section to come down. The magnets from the second section will engage the steel flange from the first section, and now the top cymbal is connected to the vertical shaft, which is connected to the high hat foot pedal and the drummer is now in full control of the high hat.

In another aspect the invention provides a releasable locking kit for a high hat cymbal set, comprising a pivotal hook member mountable on a control rod of the high hat cymbal set; a block fixedly mountable on a cymbal holder that is slidably mounted on the control rod, said block being engageable by the pivotal hook member to releasably lock the cymbal to the control rod; and an overhanding trip bar for pivoting said hook member when the cymbal is raised beyond a certain height to release said cymbal from locking engagement with the control rod.

BRIEF DESCRIPTION OF THE DRAWINGS

The invention will now be described in more detail, by way of example only, with reference to the accompanying drawings, in which.

DETAILED DESCRIPTION OF THE PREFERRED EMBODIMENTS

Figure 1A:
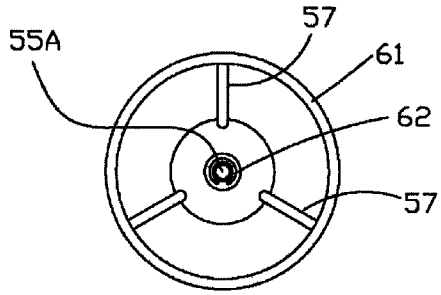
FIGS. 1A and 1B show an embodiment of the invention in the engaged position.
Figure 1B:
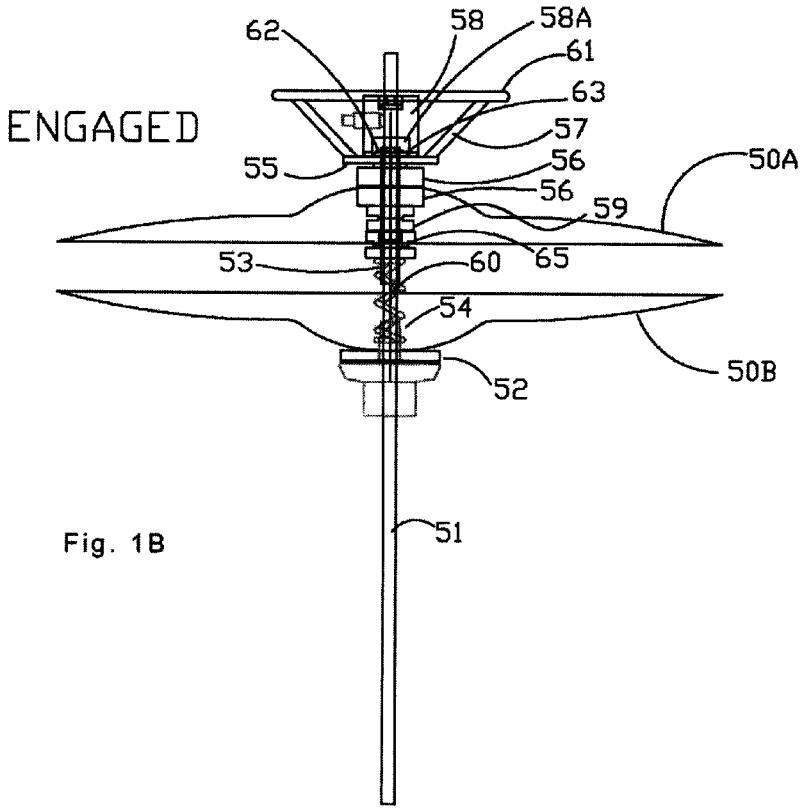

A locking mechanism in accordance with an embodiment of the invention is shown in FIGS. 1*a* and 1*b*. The lower cymbal 50*b* of a hi-hat cymbal set is fixedly mounted on the tubular support 51 by means of collar 52 in a conventional manner. The upper cymbal 50*a* is mounted on an externally threaded sleeve 53, which slides on tubular support 51. Depression of the foot pedal (not shown) will bring the upper cymbal 50*a* into contact with the lower cymbal 50*b* as a result of the control rod 60 travelling up and down within the tubular support 51. Typically the control rod 60 is spring-biased into the raised position so that depression of the foot pedal, not shown, brings it down into engagement with the lower cymbal 50*b*.

A metal disk 55, which is connected to strike ring 61 by upwardly and outwardly inclined arms 57, is also mounted on the sleeve 53 by means of a resilient grommet 62, made, for example, of rubber or elastomeric material. The metal disk 55 is made out of a magnetic material, such as iron, which is attracted to the magnets. As a result of being mounted on the resilient grommet 62, the metal disk 55 may be tilted relative to the upper cymbal 50*a*.

A cylindrical block 58, which of course may have any suitable shape, is fixedly mounted on the protruding upper part of the control rod 60 within the tubular support 51 and contains the magnets 59 (which may be similar to the magnets in the first embodiment) at its lower end. In the engaged position, the magnets 59 are magnetically attracted to the metal disk 55 to bring the lower surface of the block 58 into engagement with the upper surface of the metal disk to so that the upper cymbal 50*a* rises and falls with the control rod 60, which is operated by the foot pedal (not shown). The cylindrical block and metal disk together form a clutch mechanism permitting release of the upper cymbal 50*a* from the control rod.

An adjustable spring 54 extends around the support 51 between the bottom of the collar 60 and the lower cymbal 50*b*. The spring 54 terminates in an upper set nut 65 screwed onto the threaded sleeve 53. The position of the set nut 65 determines the amount of spring that protrudes below the upper cymbal.

The spring 54 allows the drummer to adjust the force with which the top cymbal 50*a* sits on the lower cymbal 50*b* in the disengaged position. Screwing the spring 54 upward allows the spring to sit tighter on the bottom cymbal when it falls due to gravity whereas screwing it downward allows takes some of the weight of the upper cymbal 50*a* and allows it to float more on the lower cymbal 50*b*.

Figure 2:
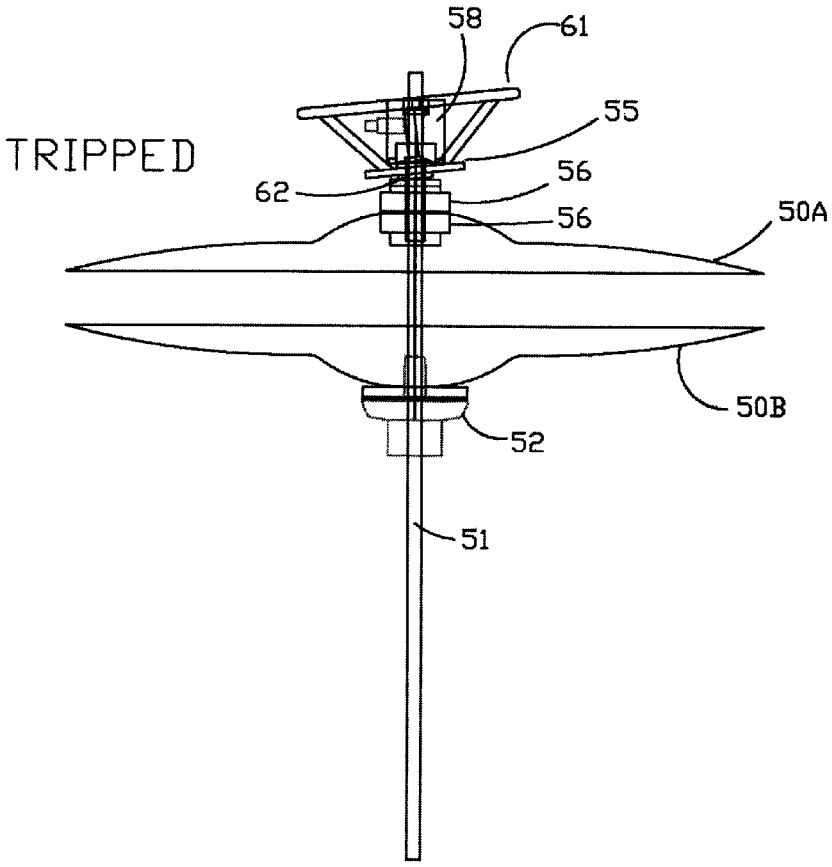
FIG. 2 shows the embodiment in the tripped position.
Figure 3:
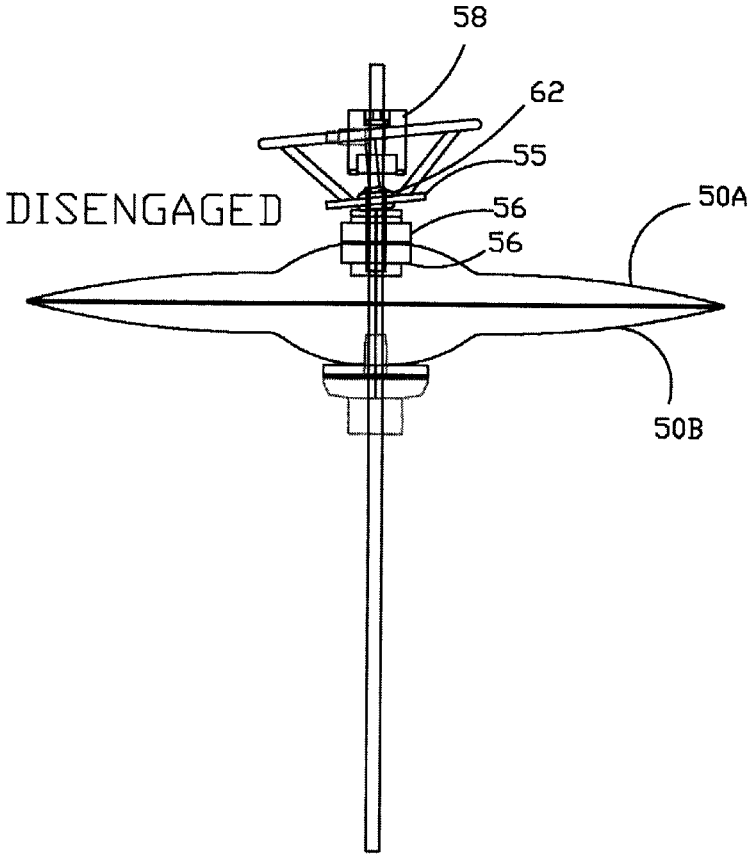
FIG. 3 shows the embodiment in the disengaged position.

In order to disengage the upper cymbal 50*a*, as shown in FIG. 2, the drummer strikes the strike ring 61, which tilts the disk 55 and grommet 62, causing the disk 55 to disengage from the magnets 59 in a similar manner to the first embodiment. Then, as shown in FIG. 3, as a result of its memory, the grommet naturally returns to its normal untilted position and the upper cymbal 50*a* falls onto the lower cymbal 50*b* together with the disk 55 and strike ring 61. The drummer may then strike the cymbals 50*a* and 50*b* in the closed position.

To re-engage the upper cymbal 50*a*, the drummer depresses the foot pedal (not shown), thereby lowering the control rod 60 to bring the magnets 59 in the cylindrical block 58 once again into contact with the disk 55. The drummer can then resume normal operation of the upper cymbal 50*a* by depressing the foot pedal.

Figure 4:
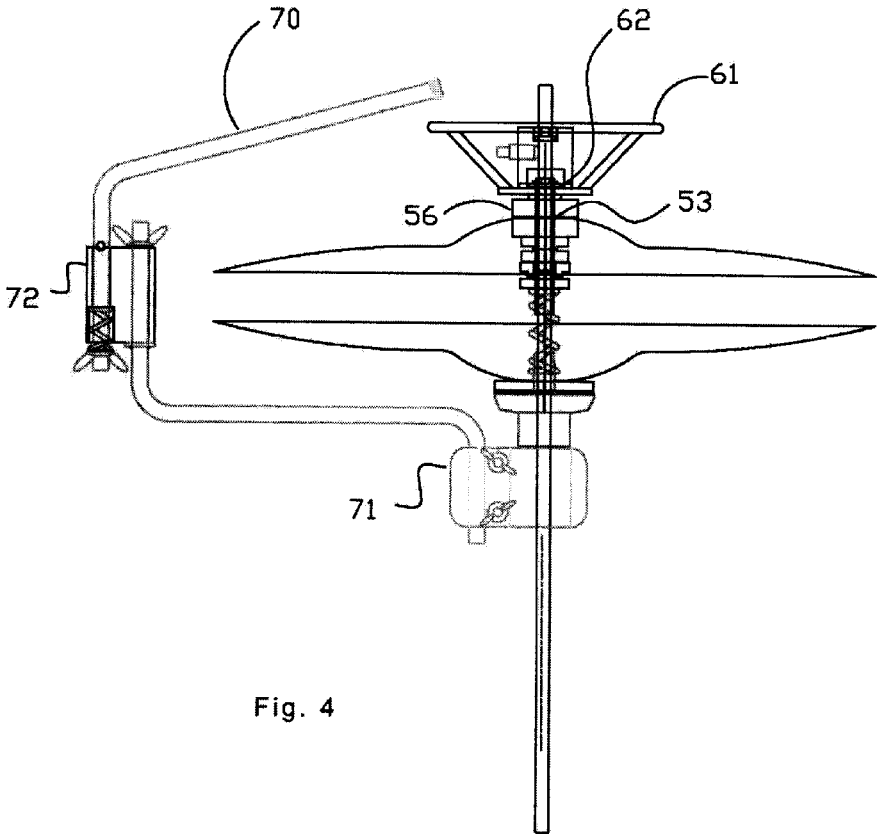
FIG. 4 shows the embodiment in the disengaged position.

As shown in FIG. 4, the upper cymbal 50*a* can also be dis-engaged by means of trip bar 70 striking the strike ring 61. The trip bar 70 is mounted on the support 51 by means of clamp 71 via pivot block 72, which allows the trip bar 70 to be pivoted out of the way.

Figure 5:
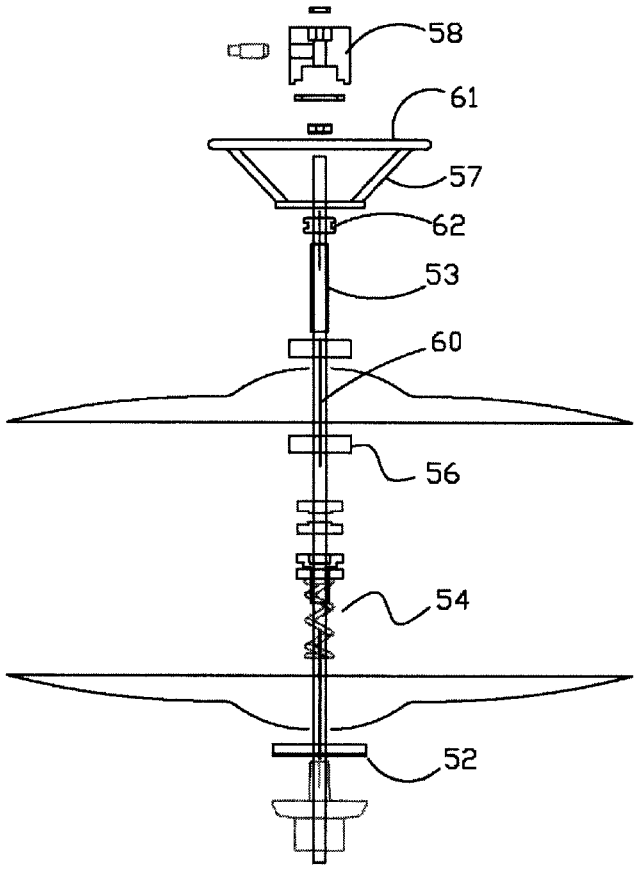
FIG. 5 is an exploded view of the embodiment.

FIG. 5 shows the individual parts of the locking mechanism in exploded view.

Figure 6:
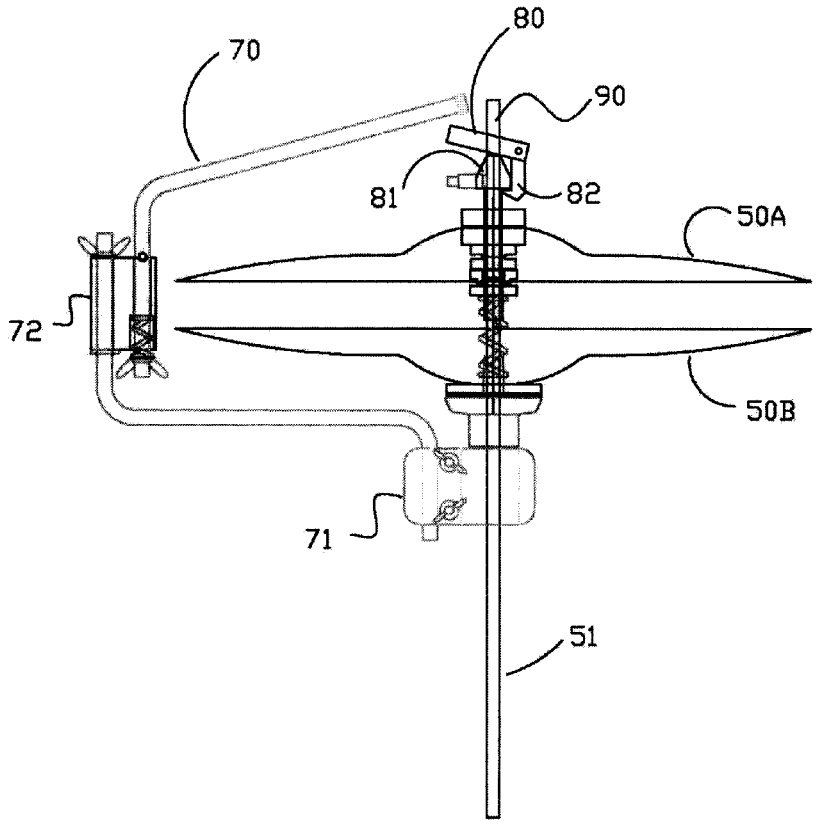
FIG. 6 shows yet another embodiment with a trip bar.

FIG. 6 shows a still further embodiment intended for use with the trip bar 70. In this embodiment instead of the strike ring 61, a pivoting arm 80 is mounted on the control rod 90 and has a hook 82, which normally engages under a conical abutment 81 on the upper end of the sleeve 53. When the arm 80 engages the trip bar 70, the arm 80 pivots, disengaging the hook 82 from the abutment 81, thus allowing the upper cymbal 50*a* to fall onto the lower cymbal 50*b*.

FIGS. 7A to 7H illustrate the detailed steps in the operation of the mechanism. In this embodiment, the trip bar 91 is mounted on a rubber grommet 92, which in turn is mounted on sleeve 93 slidably mounted on the control rod 94. Block 95 containing magnets 96 is mounted on the control rod 97 slidable within the tubular support 94.

Figure 7:
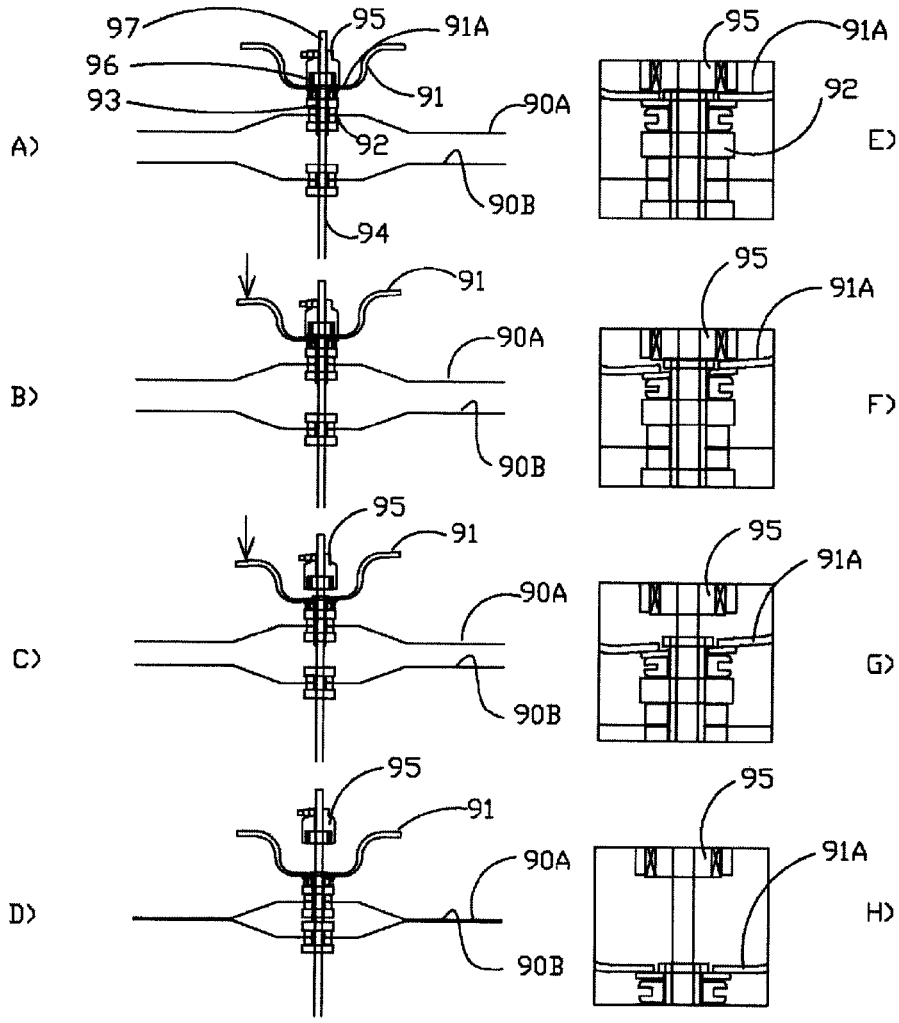
FIGS. 7A to 7H show yet another embodiment in different configurations, with FIGS. 7E to 7H showing a detail of the clutch mechanism in different stages of engagement.

The trip bar has a central disk portion 91 that is attracted to the magnets 96 in the block 95. When the trip bar 91 is tilted as shown in FIG. 14*b*, the magnetic attraction is no longer sufficient to hold the upper cymbal 90*a*, which then falls on to the lower cymbal 90*b* as shown in FIGS. 7*c* and 7*d*.

Figure 8:
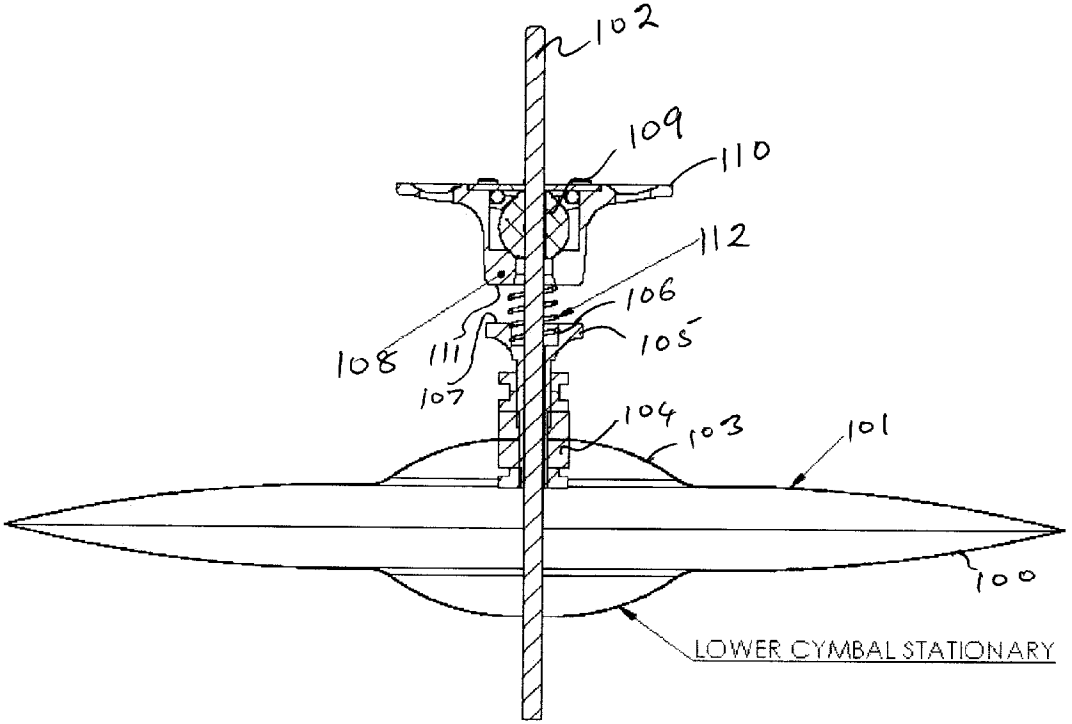
FIG. 8 shows a still further embodiment of the invention.

The embodiment shown in FIG. 8 shows a stationary lower cymbal 100 supported on stand (not shown) and upper cymbal 101 coupled to the control rod 102 through the locking mechanism to be described. In particular, the domed portion 103 of the upper cymbal 101 is retained by block 104 that is slidable on the control rod 102. The block 104 is connected to a collar 105 providing mating surface 107 with recess 106 forming part of the clutch mechanism.

Clutch housing 108 is coupled to the control rod 102, and moves up and down with it. The housing 108 pivots on ball 109 affixed to the control rod when the strike ring 110 is struck.

The lower mating surface 111 of the housing 108 contains recess magnets which normally engage magnetically with the mating surface 107 to of the collar 105 to hold the two parts together and hold the upper cymbal in the locked position so that it moves with the control rod 102.

In addition a resilient member, which in this embodiment is a compression spring 112, is mounted between the mating surfaces 107, 111, with its lower end fitted into recess 106. The spring 112 acts to tend to force the mating surfaces 107, 111 apart. Extra magnets are provided so that in the engaged position, the magnetic attraction overcomes the force of the springs.

The spring 112 may be a 15 mm spring. In an alternative embodiment, a larger spring on the exterior of the assembly may be used, for example, a spring pressing down on the dome 103 and attached directly to the control rod 102 or housing 108.

When the strike ring is tilted to trip the clutch, the magnetic attraction is broken as in the other embodiments, except that the spring 112 applies a positive force to the upper cymbal urging it against the lower cymbal.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A locking mechanism for a musical percussion instrument comprising a pair of upper and lower cymbals, wherein the lower cymbal is fixedly mounted on a tubular support, and the upper cymbal can be raised or lowered by means of a foot-operated control rod extending within the tubular support, the locking mechanism comprising:

a magnetic clutch mechanism mountable on the control rod for releasably bringing said upper cymbal into engagement with the control rod, and wherein the magnetic clutch mechanism includes respective first and second mating surfaces which in their normal position are engaged with each other by magnetic attraction, said mating surfaces being tiltable relative to each other; and wherein said clutch mechanism includes a trip member operable upon actuation to tilt at least one of said mating surfaces so as to at least partially separate mating surfaces and thereby break the engagement and allow said upper cymbal to fall onto said lower cymbal.

2. A locking mechanism as claimed in claim 1, wherein the clutch member comprises a tiltable plate attached to the upper cymbal and a block mountable on the control rod, said tiltable plate and block providing said mating surfaces.

3. A locking mechanism as claimed in claim 2, wherein said block is fixed in position on the control rod by means of a set screw.

4. A locking mechanism as claimed in claim 2, wherein magnets are provided in said block.

5. A locking mechanism as claimed in claim 2, wherein said tiltable plate is attached to said upper cymbal by means of a resilient grommet.

6. A locking mechanism as claimed in claim 5, wherein said upper cymbal is mounted on a sleeve slidable on said tubular support.

7. A locking mechanism as claimed in claim 5, wherein said resilient grommet is mounted on said sleeve.

8. A locking mechanism as claimed in claim 2, wherein said tiltable plate is connected to a raised strike ring.

9. A locking mechanism as claimed in claim 8, wherein the raised strike ring is connected to the tiltable plate by upwardly and outwardly inclined arms.

10. A locking mechanism as claimed in claim 1, further comprising a trip bar mountable beside the percussion musical instrument to actuate the trip member when the upper cymbal is raised beyond a predetermined height.

11. A locking mechanism as claimed in claim 10, wherein the trip bar is configured for mounting on the tubular support and includes a swivel mount so that it can be swivelled out of way when not required to actuate the trip member.

12. A locking mechanism as claimed in claim 11, wherein the trip bar is generally C-shaped with an upper limb configured to overhang the cymbals and actuate the trip member when the upper cymbal is raised beyond said predetermined height, and a lower limb configured for attachment to the tubular support.

13. A locking mechanism as claimed in claim 12, wherein the upper limb is swivel mounted in relation to the lower limb to permit the upper limb to be swivelled out of the way when not required to actuate the trip member.

14. A locking mechanism as claimed in claim 1, further comprising a resilient member arranged to apply a positive force to urge the cymbals apart upon actuation of the trip member.

15. A locking mechanism as claimed in claim 14, wherein the resilient member is a compression spring located between the mating surfaces.

16. A locking mechanism as claimed in claim 14, wherein the resilient member is a spring externally mounted relative to the clutch mechanism.

17. A locking mechanism as claimed in claim 14, wherein one of said first and second mating surfaces is formed on a housing tiltably mounted on a ball member affixed to the control rod.

18. A hi-hat cymbal set, comprising:

a pair of upper and lower cymbals, wherein the lower cymbal is fixedly mounted on a tubular support, and the upper cymbal can be raised or lowered by means of a foot-operated control rod extending within the tubular support, the locking mechanism; and a magnetic clutch mechanism mountable on the control rod for releasably bringing said upper cymbal into engagement with the control rod, and wherein the magnetic clutch mechanism includes respective first and second mating surfaces which in their normal position are engaged with each other by magnetic attraction, said mating surfaces being tiltable relative to each other; and wherein said clutch mechanism includes a trip member operable upon actuation to tilt at least one of said mating surfaces so as to at least partially separate mating surfaces and thereby break the engagement and allow said upper cymbal to fall onto said lower cymbal.

19. A hi-hat cymbal set as claimed in claim 18, wherein the clutch member comprises a tiltable plate attached to the upper cymbal and a block mountable on the control rod, said tiltable plate and block providing said mating surfaces.

20. A hi-hat cymbal set as claimed in claim 19, wherein said block is fixed in position on the control rod by means of a set screw.

21. A hi-hat cymbal set as claimed in claim 19, wherein magnets are provided in said block.

22. A hi-hat cymbal set as claimed in claim 19, wherein said tiltable plate is attached to said upper cymbal by means of a resilient grommet.

23. A hi-hat cymbal set as claimed in claim 22, wherein said upper cymbal is mounted on a sleeve slidable on said control rod.

24. A hi-hat cymbal set as claimed in claim 18, further comprising a resilient member located to apply a positive force to urge the cymbals apart upon actuation of the trip member.

25. A locking mechanism as claimed in claim 24, wherein the resilient member is a compression spring located between the mating surfaces.

26. A locking mechanism as claimed in claim 24, wherein the resilient member is an spring externally mounted of the clutch mechanism.

27. A locking mechanism as claimed in claim 24, wherein one of said first and second mating surfaces is formed on a housing tiltably mounted on a ball member affixed to the control rod.

28. A releasable locking kit for a high hat cymbal set, comprising:

a pivotal hook member mountable on a control rod of the high hat cymbal set;

a block fixedly mountable on a cymbal holder that is slidably mounted on the control rod, said block being engageable by the pivotal hook member to releasably lock the cymbal to the control rod; and an overhanding trip bar for pivoting said hook member when the cymbal is raised beyond a certain height to release said cymbal from locking engagement with the control rod.

* * * * *